US007275532B2

(12) United States Patent
Niemackl et al.

(10) Patent No.: US 7,275,532 B2
(45) Date of Patent: Oct. 2, 2007

(54) BOW BLIND

(76) Inventors: Douglas J. Niemackl, 1020 NW. Menninger Rd., Topeka, KS (US) 66618; Duane A. Niemackl, 2230 SW. Arvonia Pl., Topeka, KS (US) 66614

( * ) Notice: Subject to any disclaimer, the term of this patent is extended or adjusted under 35 U.S.C. 154(b) by 108 days.

(21) Appl. No.: 11/287,224

(22) Filed: Nov. 28, 2005

(65) Prior Publication Data

US 2007/0119441 A1 May 31, 2007

(51) Int. Cl.
*F41B 5/00* (2006.01)

(52) U.S. Cl. ..... 124/86; 124/23.1

(58) Field of Classification Search ..... 124/23.1, 124/86, 88; 43/1; 135/901; 428/919
See application file for complete search history.

(56) References Cited

U.S. PATENT DOCUMENTS 3,179,102 A * 4/1965 Peckham ..... 124/23.1
4,517,230 A 5/1985 Crawford
4,817,579 A 4/1989 Mathias
4,876,817 A 10/1989 Hill
4,974,575 A 12/1990 Mitchell
5,127,180 A 7/1992 Norton et al.
5,234,772 A * 8/1993 Mendick, Jr. et al. ..... 43/1
5,641,013 A * 6/1997 Wingfield ..... 160/45
5,944,041 A * 8/1999 Kitchens ..... 135/98
6,712,058 B2 3/2004 Porter
2006/0174860 A1* 8/2006 Haugen ..... 124/86

* cited by examiner

*Primary Examiner*—John A. Ricci
(74) *Attorney, Agent, or Firm*—Stephen R. Greiner

(57) ABSTRACT

A bow blind including a mounting bracket for attachment to a compound bow. The mounting bracket includes a pair of forwardly extending and downturned hooks. Radiating upwardly and outwardly from the mounting bracket is a first pair of support arms. A camouflaged panel is secured to the mounting bracket and, in turn, to bow by the first support arms and hooks.

6 Claims, 3 Drawing Sheets

BOW BLIND

FIELD OF THE INVENTION

The present invention relates generally to tents, canopies, umbrellas, canes and, more particularly, to hunting blinds and ice shelters.

BACKGROUND OF THE INVENTION

Many individuals consider bow hunting to be one of the most difficult challenges that an outdoorsman can accept. Not only does tracking game animals require great skill, but getting close enough to a game animal for making an effective shot demands much guile and patience and, too often, substantial luck. As is well known, to approach within a few dozen yards of a game animal usually requires that some form of cover exist between the pursued animal and his pursuer. Good natural cover is rare.

Some have proposed portable blinds that can be carried into the field to serve as cover for a bow hunter. To make them easier to transport, a few of these blinds have been adapted for attachment to a bow. Unfortunately, the known bow blinds have been complex and cumbersome in their construction and, thus, have not seen widespread commercial acceptance.

SUMMARY OF THE INVENTION

In light of the problems associated with the known apparatus and methods for hunting with a bow, it is a principal object of the invention to provide a blind of uncomplicated construction that is adapted for releasable attachment to a compound bow. If desired, the bow blind can be attached to a bipod to camouflage a user who prefers to employ a long-barreled firearm while hunting rather than a bow.

It is another object of the invention to provide a bow blind of the type described that serves, in conjunction with the compound bow to which it is attached, to support itself in an upright position upon the ground to conceal a user from game animals. Bottom portions of the blind deform to accommodate uneven terrain or low-growing brush to keep the blind from tipping over when set down.

It is a further object of the invention to provide a bow blind featuring a camouflage panel bearing indicia intended to blend a user into his environment. The indicia can include images of fallen leaves, dried brush, verdant woodland growth, game animals, and the like.

It is an object of the invention to provide improved features and arrangements thereof in a bow blind for the purposes described that is lightweight in construction, inexpensive to manufacture, and dependable in use.

Briefly, the bow blind in accordance with this invention achieves the intended objects by featuring a mounting bracket adapted for attachment to a bow. The mounting bracket includes a first pair of tubular socket members having bottom ends that are joined together to form a "V" and a second pair of tubular socket members having top ends that are joined together to form an inverted "V". The mounting bracket also has a pair of downturned hooks, each of which is affixed to a respective one of the second pair of socket members and extends forwardly therefrom. A threaded fastener penetrates the mounting bracket to attach the mounting bracket to the compound bow. A camouflaged panel is releasably secured to the mounting bracket and includes: a flexible sheet, a first stiffening rod secured to the top of the sheet, a second stiffening rod secured to the middle of the sheet and grasped by the downturned hooks, and a first pair of support arms, each of which having a first outer end pivotally fastened to the first stiffening rod and a first inner end removably positioned within a respective one of the a first pair of tubular socket members.

The foregoing and other objects, features, and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
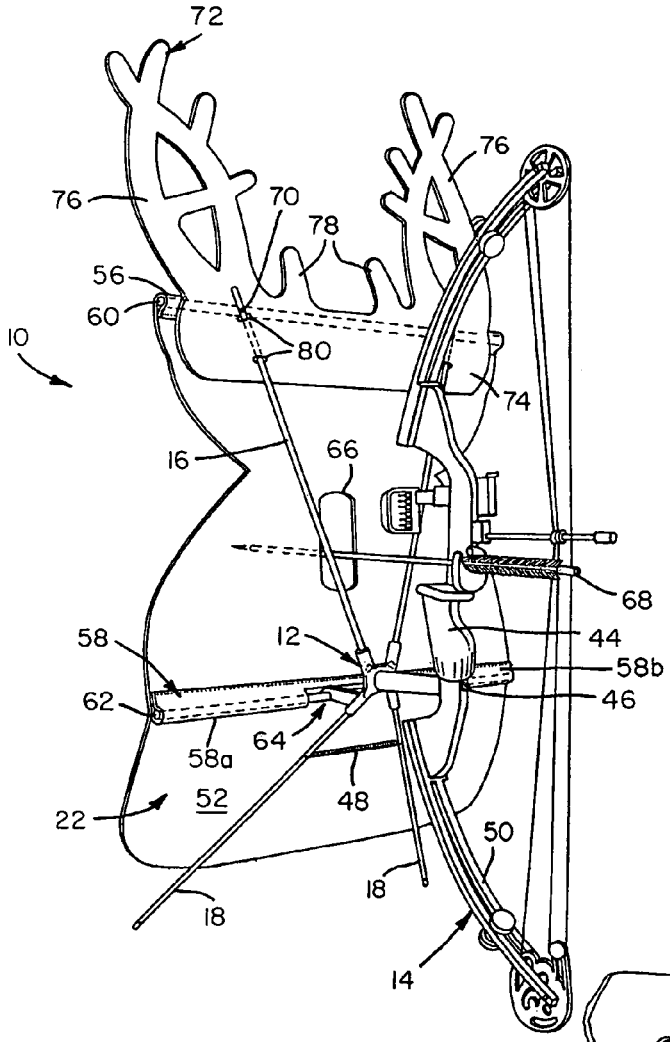
FIG. 1 is a rearward perspective view of a bow blind in accordance with the present invention being attached to a compound bow.
Figure 2:
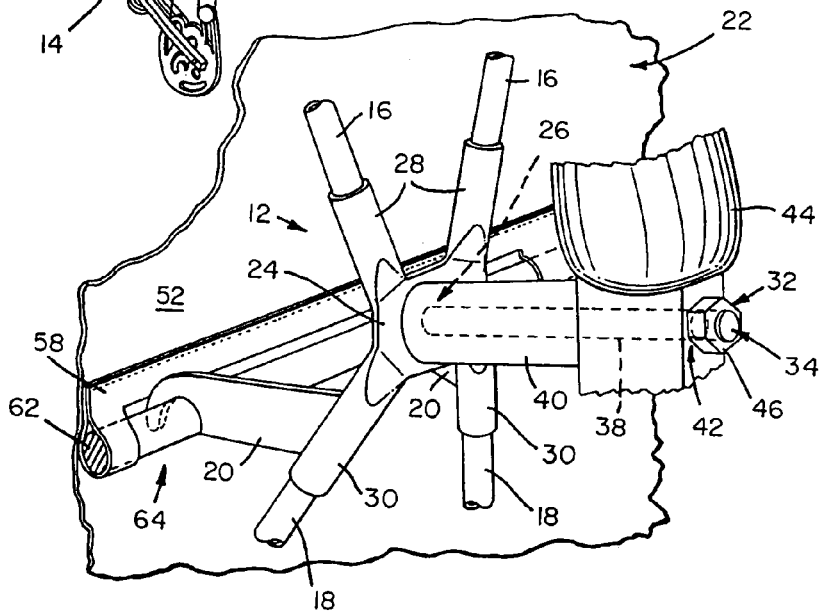
FIG. 2 is an enlarged rearward perspective view of the mounting bracket of the bow blind of FIG. 1.
Figure 3:
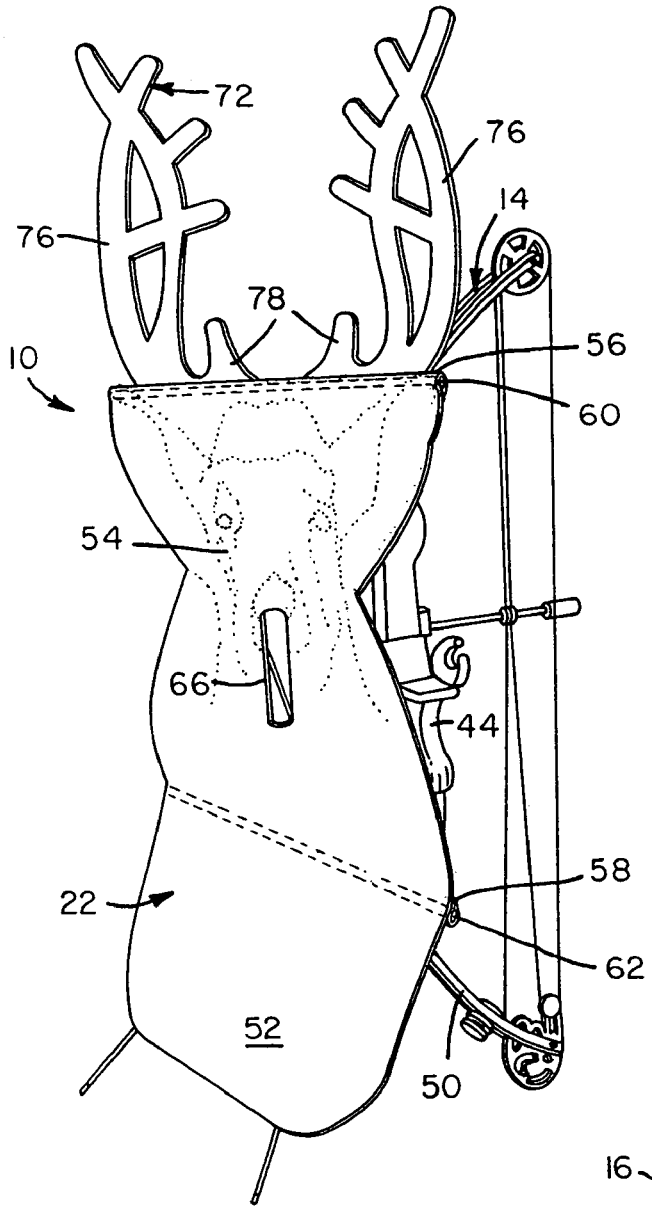
FIG. 3 is a frontward perspective view of the bow blind.
Figure 4:
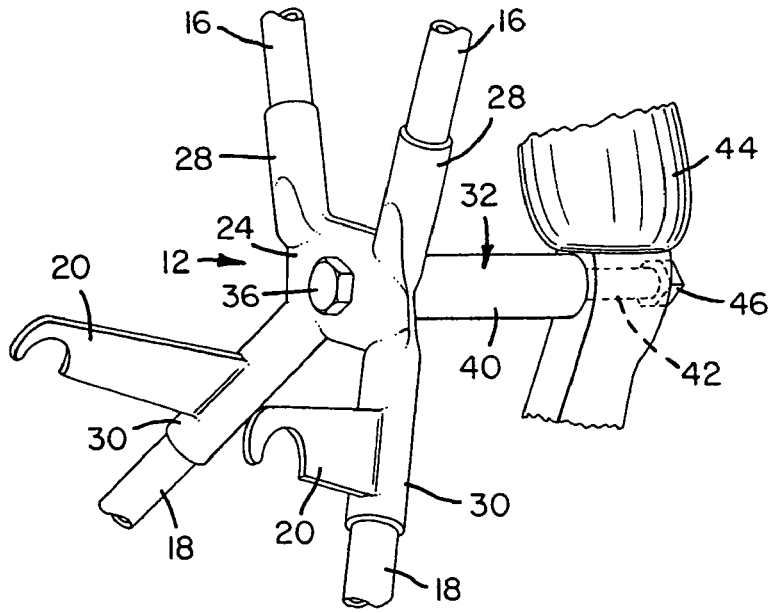
FIG. 4 is an enlarged frontward perspective view of the mounting bracket of the mounting bracket of the bow blind.

Referring now to the FIGS., a bow blind in accordance with the present invention is shown at 10. Blind 10 includes a mounting bracket 12 adapted for attachment to a compound bow 14. Radiating upwardly and outwardly from bracket 12 is a pair of support arms 16 and radiating downwardly and outwardly from bracket 12 is another pair of support arms 18. Extending forwardly from bracket 12 is a pair of downturned hooks 20. A camouflaged panel 22 is secured to bracket 12 and, in turn, to bow 14 by means of support arms 16 and hooks 20.

Mounting bracket 12 has a rectangular base plate 24 with an aperture 26 in its center. A pair of tubular socket members 28 is affixed to the top corners of base plate 24 and a pair of tubular socket members 30 is affixed to the bottom corners of base plate 24. Socket members 28 extend upwardly, forwardly, and outwardly from base plate 24 and socket members 30 extend downwardly, forwardly, and outwardly from base plate 24.

Downturned hooks 20 extend forwardly from tubular socket members 30 giving such a wide spacing or stance. If desired, however, hooks 20 could be affixed to base plate 24 or tubular socket members 28.

A fastening assembly 32 joins bracket 12 to bow 14. Fastening assembly 32 has a bolt 34 with a hexagonal head 36 positioned against the front of base plate 24. A threaded rod 38 extends rearwardly from head 36 and through aperture 26 in base plate 24. A bracket spacer tube 40 is positioned upon the rearward extension of rod 38 and abuts the back of base plate 24. The portion of rod 38 extending from tube 40 extends through a close-fitting aperture 42 in bow handgrip 44 and is fitted with a nut 46 to join assembly 32 and bracket 12 to bow 14.

Support arms 16 and 18 comprise small-gauge tubes of metal, plastic, fiberglass, graphite or other suitable material having lengths that are about one-half of the height of bow 14. The inner ends of arms 16 are inserted in socket members 28 and are held in place by friction and gravity. The inner ends of arms 18 are, likewise, inserted in socket members 30 and are held in place by friction increased by an inward torque applied to arms 18 by an elastomeric band or spring 48 connecting their midpoints.

Since socket members 28 and 30 extend forwardly from base plate 24, linear arms 16 and 18 trend in a similar direction from base plate 24 when inserted therein. Thus, the outer ends of arms 16 and 18 project well forward of bow 14. Such an arrangement permits panel 22 to be held at a distance from bow 14 so that it will not impede aiming and firing. Furthermore, arms 18 and the bottom limb 50 of bow 14 form a stable, tripod-like arrangement that keeps both panel 22 and bow 14 upright when set on the ground to shield a hunter from the gaze of game animals and to provide immediate access to bow 14 in the event that a game animal draws near.

Camouflage panel 22 includes a rectangular sheet 52 of fabric or other suitable material having indicia 54 on its front that tends to blend sheet 52, and a hunter shielded behind it, into the environment. Such indicia 54 may include images of game animals like deer (shown), antelope, and turkeys or may include patterns simulative of brush, rock, and dirt among other things. Sheet 52 need not be unitary in its construction and can, if desired, be a patchwork of numerous smaller elements meant to hang loosely and sway in a breeze in the manner of leaves.

Sheet 52 is provided with a pair of horizontal sleeves 56 and 58 for receiving stiffening rods 60 and 62 therein. Sleeve 56 is sewn along its top and bottom margins to the top of sheet 52 and extends from one side of sheet 52 to the other. Sleeve 58, however, is sewn along its top and bottom margins to sheet 52 at a point about midway between the top and bottom of sheet 52 and has two, axially aligned segments 58*a* and 58*b* on opposite sides of sheet 52. Thus, a gap 64 is provided between segments 58*a* and 58*b*. Above gap 64, proximate the center of sheet 52, a vertically elongated opening 66 is provided in sheet 52 through which an arrow 68 can be fired from bow 14.

Stiffening rods 60 and 62 are provided in sleeves 56 and 58 to maintain sheet 52 in an outstretched and substantially planar configuration when deployed on bow 14. Pivot pins 70 penetrate sleeve 56 to connect the opposite ends of rod 60 to the outer ends of arms 16. Downturned hooks 20 catch, and press downwardly upon, the top of rod 62 near the midpoint thereof where rod 62 is exposed in gap 64 between sleeve segments 58*a* and 58*b*.

A camouflage panel extension 72 can be employed with panel 22 to further screen a hunter from view. Extension 72 is formed from stiff plastic sheeting and includes a crosspiece 74 from which a number of primary branches 76 of large size and secondary branches 78 of smaller size extend upwardly. As shown, crosspiece 74 is sized to extend across the top of panel 22 and is provided at each end with a pair of vertically aligned bores 80 through which arms 16 can be threaded. Once arms 16 are extended through bores 80, friction serves to retain extension 72 at the top of panel 22 with branches 76 and 78 extending upwardly therefrom through which a hunter can peer. Branches 76 and 78 are, in the illustrated embodiment, shaped like the antlers of a deer to correspond with indicia 54 provided on sheet 52 but branches 76 and 78 can be provided to simulate tree limbs, rocks, etc.

The use of bow blind 10 is straightforward. First, bolt 34 is extended through both aperture 26 in base plate 24 and spacer tube 40 so that threaded rod 38 projects from tube 40. Then, rod 38 is pressed through aperture 42 in bow handgrip 44 and is fitted with a nut 46 to join assembly 32 and bracket 12 to bow 14. Now, the outer ends of arms 16, previously connected by pins 70 to rod 60 in panel sleeve 56, are woven through bores 80 in panel extension 72 so that crosspiece 74 is positioned adjacent the top of panel 22 and branches 76 and 78 extend upwardly from panel 22. Next, the inner ends of arms 16 are inserted into tubular socket members 28 and the inner ends of arms 18 are inserted into tubular socket members 30. Finally, the middle of rod 62, previously inserted into panel sleeve 58, is positioned beneath hooks 20 so as to be grasped by them.

Bow 14 is fired in substantially the same manner with blind 10 secured to it as it would be without blind 10. A hunter, however, can approach game animals more closely than was formerly the case since they have a more difficult time seeing the hunter. Sighting of a shot is accomplished through opening 66 in sheet 54 through which an arrow 68 is fired. Since the hunter is unlikely to be detected by game prior to making a shot, it can be more accurately and deliberately done. Because the hunter is closer to game and has more time to aim bow 14 before firing arrow 68, the hunter is likely to have greater success than has been possible in the past.

When a hunting session is over, panel 22, panel extension 72, and arms 16 and 18 are detached from bracket 12 by reversing the steps set forth above. These things can be collapsed and rolled up together and conveniently stored in the trunk of an automobile or an arrow quiver. Bracket 12 can be stored in place on bow 14 for easy access. Thus, bow blind 10 is always ready for immediate reuse.

Figure 5:
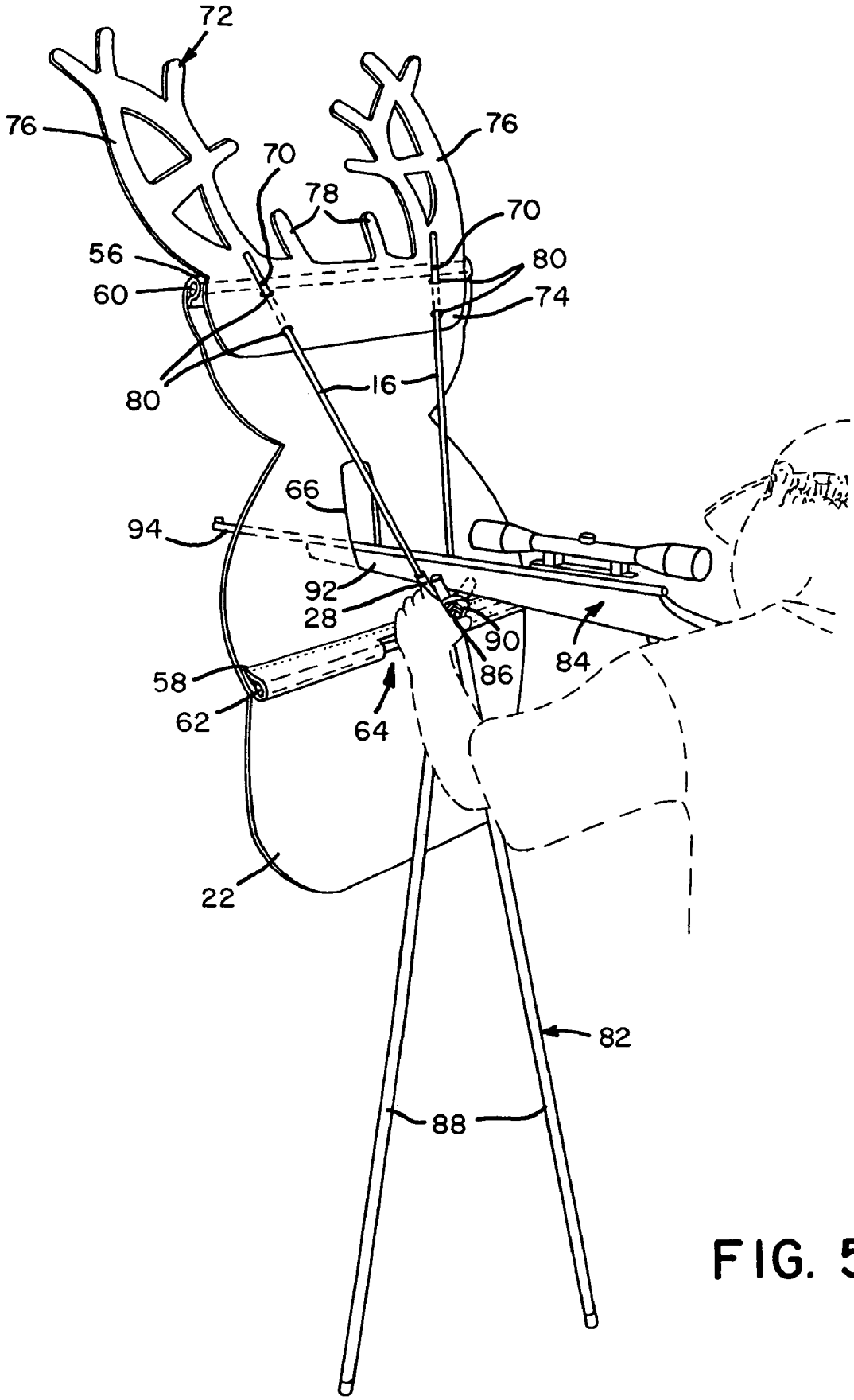
FIG. 5 is a rearward perspective view of the bow blind being attached to a bipod.

Bow blind 10, minus arms 18 and fastening assembly 32 that are not needed, can be employed to shield hunters using firearms. To do this, blind 10 is simply bolted to the top of a bipod 82 of the sort typically used by a hunter to support a rifle 84 for steady aiming and firing. As shown in FIG. 5, a bolt 86 is extended through base plate 24 of bracket 12 and axially aligned apertures (not shown) at the tops of telescoping bipod legs 88 and secured there by means of a nut 90. Bolt 86, then, serves as the pivot pin for legs 88 whose bottoms can placed upon the ground in a spaced-apart condition to provide a stable support for blind 10 and rifle 84 whose forearm 92 is rested atop base plate 24 between tubular socket members 28 and whose barrel 94 is projected through opening 66 in sheet 52. A hunter using bipod 82 is fully shielded from view behind panel 22 and extension 72. Thus, bow blind 10 can serve hunters that actively pursue game with bows as well as firearms.

While the invention has been described with a high degree of particularity, it will be appreciated by those skilled in the art that modifications may be made to it. Therefore, it is to be understood that the present invention is not limited to the sole embodiment described above, but encompasses any and all embodiments within the scope of the following claims.

We claim:

1. A bow blind, comprising:

a mounting bracket being adapted for attachment to a compound bow, said mounting bracket including:

a base plate with a central aperture;

a first pair of tubular socket members being affixed to the top of said base plate and extending upwardly, forwardly, and outwardly from said base plate;

a second pair of tubular socket members being affixed to the bottom of said base plate and extending downwardly, forwardly and outwardly from said base plate; and, a pair of downturned hooks, each of which being affixed to a respective one of said second pair of tubular socket members;

a fastening assembly for joining said mounting bracket to the compound bow, said fastening assembly including:

a bracket spacer tube abutting the back of said base plate and being in axial alignment with said central aperture in said base plate;

a threaded fastener penetrating said central aperture and said bracket spacer tube and being adapted to penetrate the compound bow;

a camouflaged panel being releasably secured to said mounting bracket, said camouflaged panel including:

a flexible sheet having a first horizontal sleeve positioned at the top of said flexible sheet and a second horizontal sleeve positioned at the middle of said flexible sheet, said flexible sheet also having an opening between said first horizontal sleeve and said second horizontal sleeve for the passage of an arrow fired from the compound bow;

a first stiffening rod being located in said first horizontal sleeve;

a second stiffening rod being located in said second horizontal sleeve and being releasably grasped by said downturned hooks; and, a first pair of support arms, each of said first pair of support arms respectively having a first inner end and a first outer end, said first outer end of each of said first pair of support arms being pivotally fastened to said first stiffening rod, and said first inner end of each of said first pair of support arms being removably positioned within a respective one of said a first pair of tubular socket members.

2. The bow blind according to claim 1 further comprising a second pair of support arms, each of said second pair of support arms respectively having a second inner end and a second outer end, and said second inner end of each of said second pair of support arms being removably positioned within a respective one of said second pair of tubular socket members.

3. The bow blind according to claim 1 further comprising a camouflage panel extension being releasably secured to said first pair of support arms and extending upwardly from said camouflaged panel, and said panel extension being provided with a plurality of branches for obscuring a user positioned behind said bow blind.

4. A bow blind, comprising:

a mounting bracket being adapted for attachment to a compound bow, said mounting bracket including:

a first pair of tubular socket members having bottom ends that are joined together to form a "V";

a second pair of tubular socket members having top ends that are joined together to form an inverted "V" and said top ends of said second tubular socket members being affixed to said bottom ends of said first pair of tubular socket members; and, a pair of downturned hooks, each of which being affixed to a respective one of said second pair of tubular socket members and extending forwardly therefrom;

a threaded fastener penetrating said mounting bracket for attaching said mounting bracket to the compound bow;

a camouflaged panel being releasably secured to said mounting bracket, said camouflaged panel including:

a flexible sheet;

a first stiffening rod being secured to the top of said flexible sheet;

a second stiffening rod being secured to the middle of said flexible sheet and being releasably grasped by said downturned hooks; and, a first pair of support arms, each of said first pair of support arms respectively having a first inner end and a first outer end, said first outer end of each of said first pair of support arms being pivotally fastened to said first stiffening rod, and said first inner end of each of said first pair of support arms being removably positioned within a respective one of said a first pair of tubular socket members.

5. The bow blind according to claim 4 further comprising a second pair of support arms, each of said second pair of support arms respectively having a second inner end and a second outer end, and said second inner end of each of said second pair of support arms being removably positioned within a respective one of said second pair of tubular socket members.

6. The bow blind according to claim 4 further comprising a camouflage panel extension being releasably secured to said first pair of support arms and extending upwardly from said camouflaged panel, and said panel extension being provided with a plurality of branches for obscuring a user positioned behind said bow blind.

* * * * *